US011358040B2

(12) United States Patent
Frederickson

(10) Patent No.: US 11,358,040 B2
(45) **Date of Patent: *Jun. 14, 2022**

(54) GOLF CLUB HEAD WITH ADJUSTABLE SOLE WEIGHT

(71) Applicant: Callaway Golf Company, Carlsbad, CA (US)

(72) Inventor: Austin L. Frederickson, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/396,925

(22) Filed: Aug. 9, 2021

(65) Prior Publication Data

US 2021/0362013 A1 Nov. 25, 2021

Related U.S. Application Data

(63) Continuation of application No. 17/092,912, filed on Nov. 9, 2020, now Pat. No. 11,083,939, which is a continuation of application No. 16/806,710, filed on Mar. 2, 2020, now Pat. No. 10,835,791.

(51) Int. Cl.

| | |
|---|---|
| ***A63B 53/00*** | (2015.01) |
| ***A63B 53/08*** | (2015.01) |
| ***A63B 53/06*** | (2015.01) |
| *A63B 53/04* | (2015.01) |

(52) U.S. Cl.

CPC ..... *A63B 53/08* (2013.01); *A63B 53/06* (2013.01); *A63B 53/0433* (2020.08); *A63B 53/0466* (2013.01); *A63B 2209/02* (2013.01)

(58) Field of Classification Search

CPC ..... A63B 2053/0491; A63B 53/0416; A63B 53/0466; A63B 60/52; A63B 69/36; A63B 53/06

USPC ..... 473/350, 330–339

See application file for complete search history.

(56) References Cited

U.S. PATENT DOCUMENTS

| | | | | |
|---|---|---|---|---|
| 10,835,791 | B1 * | 11/2020 | Frederickson | A63B 60/04 |
| 11,083,939 | B1 * | 8/2021 | Frederickson | A63B 53/06 |
| 2005/0009625 | A1 * | 1/2005 | Stites | A63B 60/00 473/338 |
| 2010/0331103 | A1 * | 12/2010 | Takahashi | A63B 53/0466 473/345 |
| 2020/0054926 | A1 * | 2/2020 | Frederickson | A63B 53/06 |
| 2021/0362013 | A1 * | 11/2021 | Frederickson | A63B 53/08 |

* cited by examiner

*Primary Examiner* — Eugene L Kim
*Assistant Examiner* — Matthew B Stanczak
(74) *Attorney, Agent, or Firm* — Rebecca Hanovice; Michael Catania; Sonia Lari

(57) ABSTRACT

A golf club head with an adjustable weight assembly that includes a pair of stacked, rotatable circular plates with through-slots and a slidable weight that can move within the slots and clamp the plates together so that they are reversibly fixed to a body portion is disclosed herein. The plates are preferably composed of a lightweight material such as composite, and are located on the sole so that the weight assembly is visible to a user. The plate and slidable weight combination and allows for an increased range of personal performance customization by way of adjustability and interchangeability without using up available discretionary mass in the golf club head.

20 Claims, 5 Drawing Sheets

MAX MOI

MAX DRAW

MIN DRAW

MIN SPIN

MAX FADE

MIN FADE

GOLF CLUB HEAD WITH ADJUSTABLE SOLE WEIGHT

CROSS REFERENCES TO RELATED APPLICATIONS

The present application claims is a continuation of U.S. patent application Ser. No. 17/092,912, filed on Nov. 9, 2020, and issued on Aug. 10, 2021, as U.S. Pat. No. 11,083,939, which is a continuation of U.S. patent application Ser. No. 16/806,710, filed on Mar. 2, 2020, and issued on Nov. 17, 2020, as U.S. Pat. No. 10,835,791, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head with an adjustable sole weight assembly that has a large range of positions across which a user can easily adjust the overall center of gravity.

Description of the Related Art

Golf club heads with adjustable features that permit users to modify the location of the club head's center of gravity (CG) and weight distribution are valued by golfers, as these adjustability mechanisms allow golfers to control the performance of the golf club head. This is particularly desirable in drivers. The prior art includes several different solutions for adjustable weighting in golf club heads, but these solutions do not optimize weight adjustment. The most common of these is a track in which a weight can slide, manipulating the CG along horizontal, heel to toe, side-to-side, and/or a front to back directions. Several existing systems can achieve a combination of these goals by employing multiple tracks (e.g., U.S. Pat. No. 9,623,294) or a track on a rotating arm (e.g., U.S. Pat. No. 9,636,553). One disadvantage common to these prior art systems is the weight required to support tracks and arm features. Therefore, there is a need for a golf club weighting mechanism that allows for simple and flexible center of gravity adjustability without negatively affecting other properties of the golf club head.

BRIEF SUMMARY OF THE INVENTION

The present invention presents a novel way of working with adjustable products. The present invention allows consumers to easily move and fix a weight at any location within the sole. The objective of this invention is to provide an adjustable weight with minimal or no effect on appearance at address while maximizing the ability of the weight to adjust center of gravity location.

One aspect of the present invention is a golf club head comprising a body comprising a striking face, a heel side, a toe side, a rear side, a sole, and a circular opening in the sole at least partially encircled by a retention structure, a first circular plate comprising a first central region, an edge region encircling the first central region, and a first slot disposed in the first central region, a second circular plate comprising a second central region, at least one spring finger extending from the second central region, and a second slot disposed in the second central region, and a weight assembly comprising a weight portion, a screw, and a nut, wherein the retention structure comprises a first lip, a second lip, and a groove area between the first and second lips, wherein a portion of each of the edge region and the at least one spring finger is disposed within the groove area so that the first and second central regions of the first and second circular plates are at least partially suspended within the circular opening in the sole, wherein a portion of the first slot overlaps a portion of the second slot, and wherein the screw extends through the weight portion, the first slot, and the second slot to engage the nut. Tightening the screw presses the first and second circular plates together between the weight portion and the nut and causes the edge region to press against the first lip and the at least one spring finger to press against the second lip to reversibly fix the first and second plates to the body.

In some embodiments, the at least one spring finger may be connected to the central region by a curved knuckle portion. In other embodiments, the at least one spring finger may comprise a plurality of spring fingers, and each of the plurality of spring fingers may be separated from adjacent spring fingers by one of a plurality of dividing slots. In still other embodiments, the body may be composed of a first material having a first density, and at least one of the first plate and second plate may be composed of a second material having a second density that is lower than the first density. In further embodiments, the first material may be a metal alloy and the second material may be selected from the group consisting of plastic and carbon composite. In an alternative embodiment, each of the first and second plates may be composed of a carbon composite material. In any of the embodiments, the second plate may comprise a lattice support structure.

In some embodiments, the second lip may comprise a flange and a shelf, the first lip may at least partially overlap the shelf, and the first edge region may abut the flange. In a further embodiment, the shelf may comprise a concavity. In any of the embodiments, the first slot may be linear and the second slot may be curved. In some embodiments, each of the first and second central regions may have a concave curvature, which may be approximately equivalent to a curvature of the sole.

Another aspect of the present invention is a driver-type golf club head comprising a metal alloy body comprising a face portion with a face opening, a sole, a hosel, a heel side proximate the hosel, a toe side opposite the heel side, a rear edge, an upper opening, a circular opening in the sole, a retention structure encircling the circular opening, and a hollow interior, a carbon composite crown affixed to the body to enclose the upper opening, a metal alloy face insert affixed to the body to close the face opening, a first circular plate comprising a first central region, an edge region encircling the first central region, a linear track disposed in the first central region and extending from a center point of the first central region towards the edge region, and a first slot disposed in the linear track, a second circular plate comprising a second central region, a plurality of spring fingers extending from the second central region, and a second slot disposed in the second central region, and a slidable weight comprising a weight portion, a screw, and a nut, wherein the retention structure comprises a first lip, a second lip, and a groove area between the first and second lips, wherein each of the first and second circular plates is composed of a molded carbon composite material, wherein each of the first and central regions comprises a concave curvature with respect to the hollow interior, wherein the first circular plate is disposed above the second circular plate with respect to the hollow interior, wherein a portion of each of the edge region and each spring finger of the plurality of spring fingers is disposed within the groove area so that the first and second central regions of the first and second circular plates are at least partially suspended within the circular opening in the sole, wherein a portion of the first slot overlaps a portion of the second slot, and wherein the screw extends through the weight portion, the first slot, and the second slot to engage the nut.

In some embodiments, the second slot may be curved. In other embodiments, the second lip may comprise a flange and a shelf, the first lip may at least partially overlap the shelf, and the edge region may abut the flange. In a further embodiment, each spring finger of the plurality of spring fingers may be connected to the central region by a curved knuckle portion, and each knuckle portion may rest against the edge region of the first circular plate. In another embodiment, when the slidable weight is in a loosened state, the spring fingers may not make contact with the first lip, and when the slidable weight is in a tightened state, the spring fingers may press against the first lip and the edge region may press against the flange to reversibly fix the first and second plates to the body. In any of the embodiments, each of the first and second plates may be rotatable with respect to one another and the body when the slidable weight is in a loosened state. In any of the embodiments, moving the slidable weight to different locations within the slots may alter the mass properties of the driver-type golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
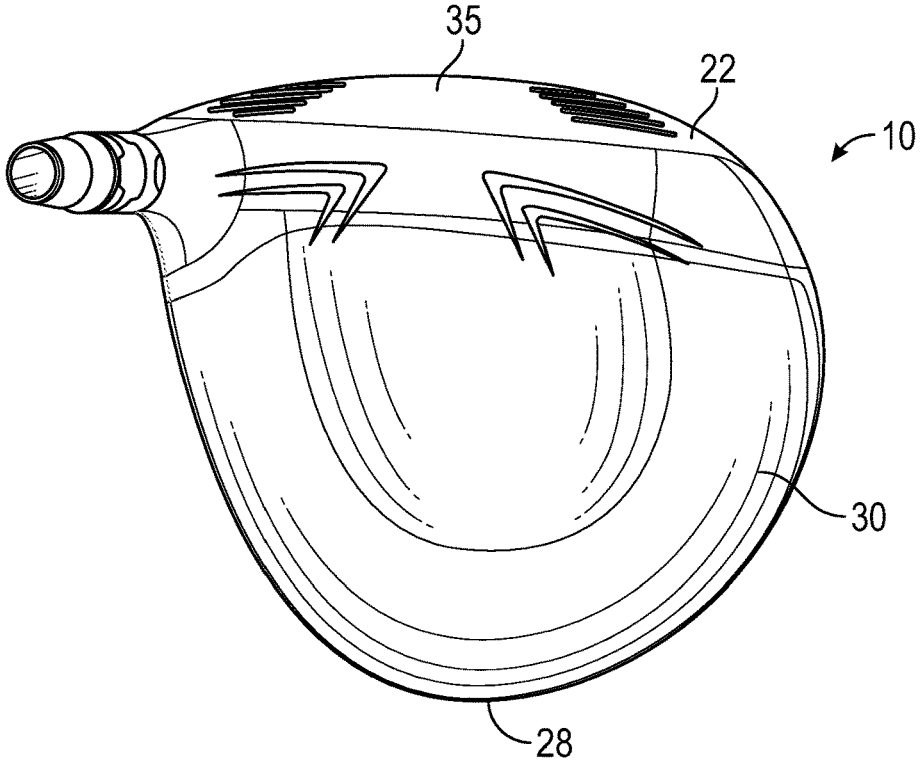
FIG. 1 is a top plan view of the golf club head of the present invention.
Figure 2:
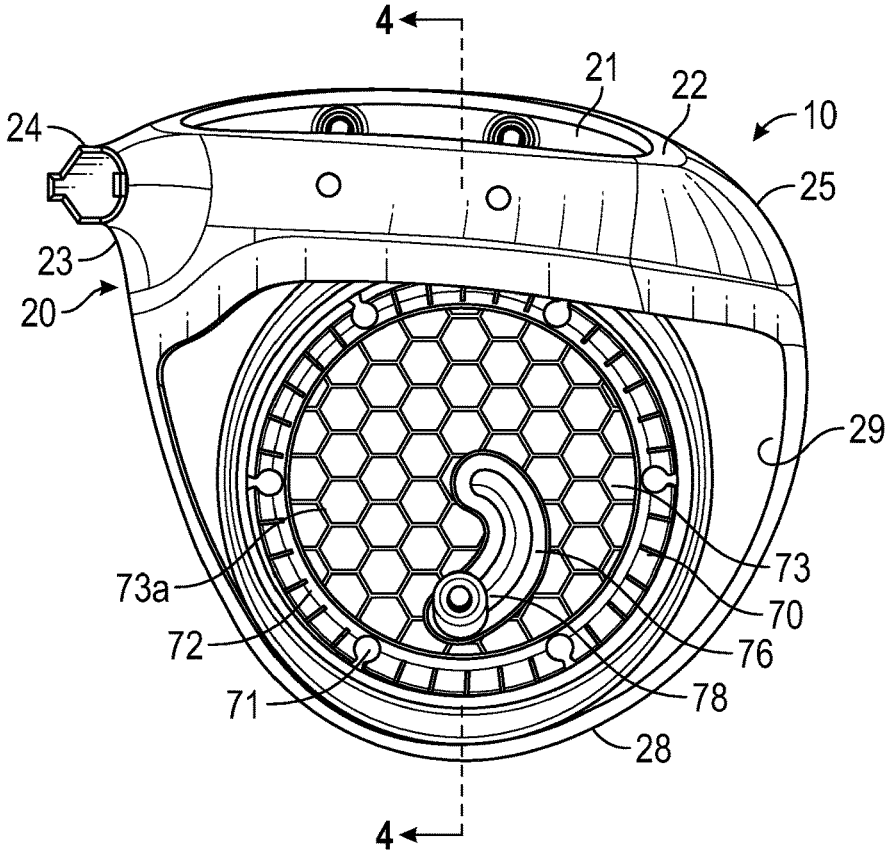
FIG. 2 is a top elevational view of the embodiment shown in FIG. 1 with the crown removed.
Figure 3:
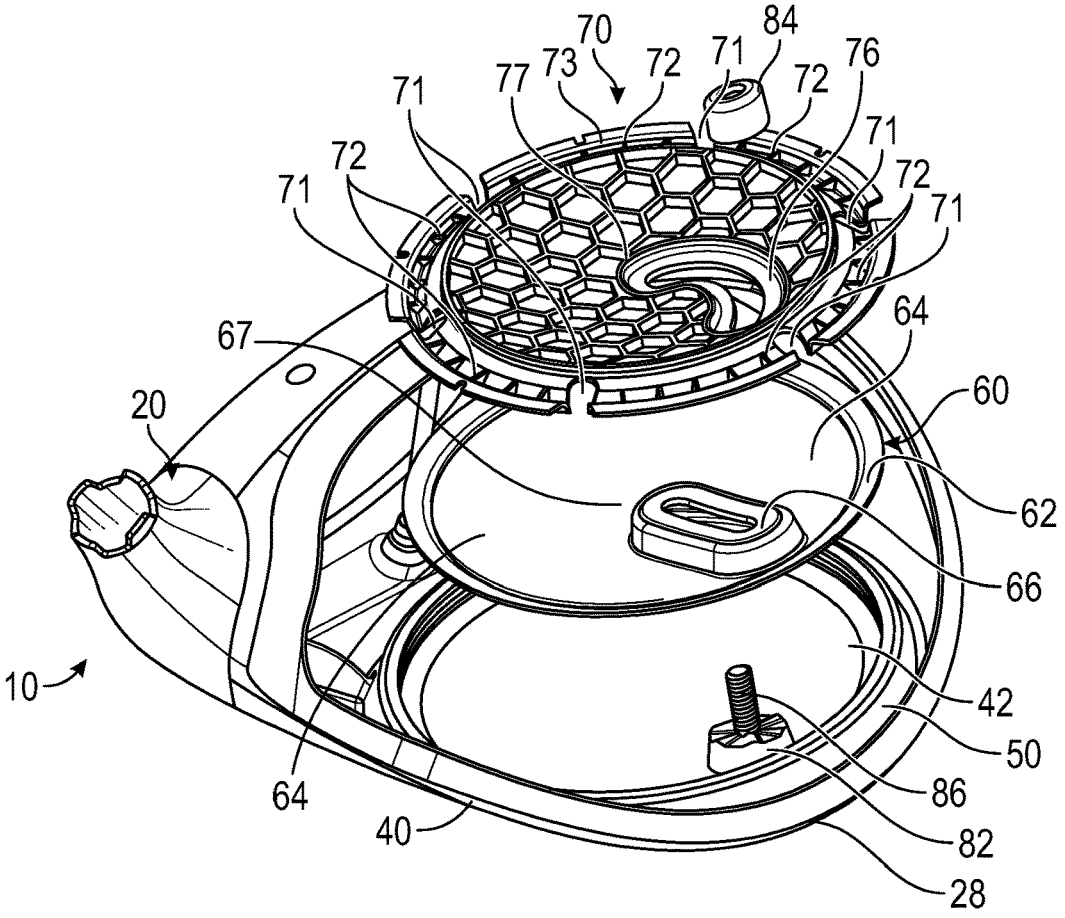
FIG. 3 is an exploded view of the embodiment shown in FIG. 2.
Figure 4:
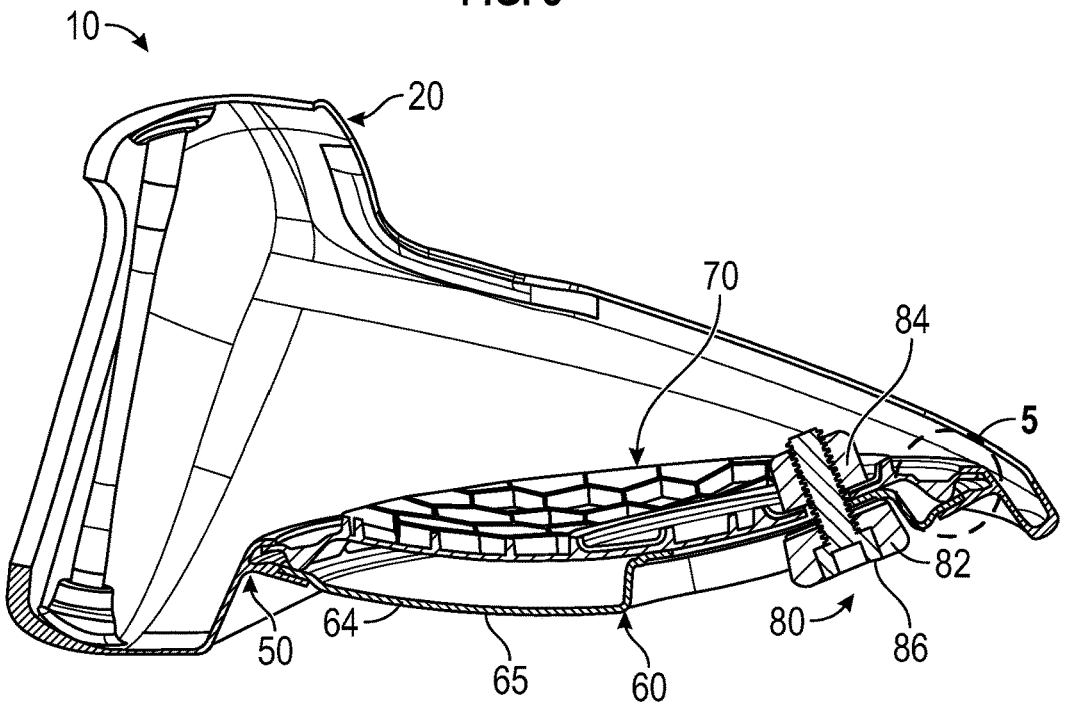
FIG. 4 is a cross-sectional view of the embodiment shown in FIG. 2 along lines 4-4.
Figure 5:
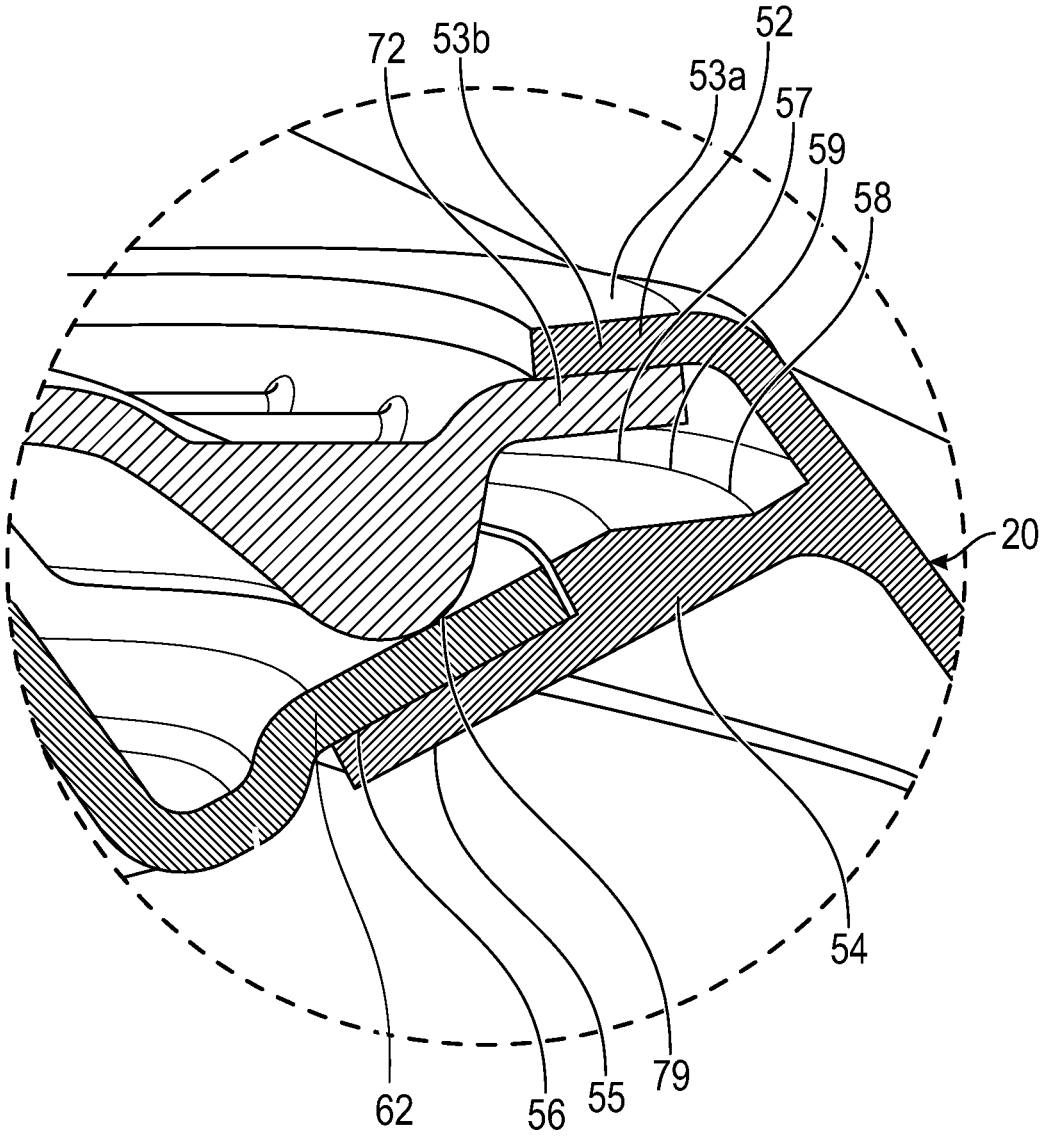
FIG. 5 is an enlarged view of the circled portion of the embodiment shown in FIG. 4.

The design approaches described herein are based on a construction used in a driver head characterized by a composite crown adhesively bonded to a cast titanium body. In particular, the inventive weight assembly involves a pair of composite plates that are clamped together to affix a moveable weight in a position chosen by a user. Composite is a lightweight material that has excellent vibration dampening properties, so the weight of the inventive assembly is minimized, allowing the golf club to achieve higher moments of inertia. This particular construction approach permits the crown configuration to be adapted to the inventive weighting scheme with minimal impact on weight and function. However, the inventive weight assembly disclosed herein can be used with other constructions, including all titanium, all composite, and a composite body with metal face cup. The weight assembly of the present invention is visible and allows for an increased range of personal performance customization by way of adjustability and interchangeability.

A preferred embodiment of the present invention is shown in FIGS. 1-6. The golf club head 10, which preferably is a driver or a large fairway wood, comprises a body 20 having a face portion 22 with a face opening 21, a heel side 23 proximate a hosel 26, a toe side 25, a rear edge 28, a sole 40, and an upper opening 29. These portions of the body 20 are preferably integrally cast with one another in a lost wax casting process. The upper opening may then be covered by a crown 30, which preferably is formed separately from the body 20 from a low density material such as plastic or carbon composite, to enclose the hollow interior 24. The face opening 21 is filled with a face insert 35, which is preferably laser welded to the body 20 to close the face opening 21.

The sole 40 comprises a circular opening 42 that preferably has a diameter of at least one inch, and preferably a diameter of at least two inches. The circular opening 42 is encircled by a retention structure 50 comprising a first lip 52 with an inner surface 53*a* facing the hollow interior 24, and a second lip 54 with an outer surface 55 facing the exterior of the golf club head. The second lip 54 includes a flange 56 extending from, and attached to, a shelf portion 58 that preferably includes a concavity 57 to maximize available space. At least a portion of the first lip 52 and the second lip 54 overlap with one another to form a groove area 59 that at least partially, and preferably completely, encircles the circular opening 42. Preferably, the first lip 52 overlaps only the shelf portion 58, and the flange 56 radially extends into the circular opening 42, with a contact side 56*a* facing the hollow interior 24. The first lip also includes a groove-facing surface 53*b* facing the groove area 59 and at least a part of the shelf portion 58.

A first, circular plate 60 composed of a lightweight material, preferably a prepreg carbon composite or plastic, is inserted into the circular opening. The first plate 60 comprises an interior facing surface 61, an edge region 62, a central region 64 with a slight concave curvature that is close to, or matches, the curvature of the sole 40, and a linear or straight, elongated track or channel portion 66 extending radially between a center point 67 and the edge region 62 that includes a through-opening or slot 68. The edge region 62 abuts the flange 56 so that the first plate 60 covers the circular opening 42, and an exterior surface 65 of the central region 64 and the channel portion 66 are facing the exterior of the golf club head 10.

A second, circular plate 70, also referred to herein as a spring plate, comprises a slightly concave central region 74 with a curvature similar to, or matching, the curvature of the central region 64 of the first plate 60 and/or the curvature of the sole 40. The central region 74 of the spring plate 70 includes a curved slot 78 that that extends in a spiral from a center point 77. A smooth shelf region 76 encircles the slot 78, which allows the slidable weight 80 described below to move more freely when in a loosened state. The spring plate 70 comprises an edge region made up of a plurality of spring fingers 72 separated from one another by a plurality of divider slots 71, and a curved knuckle portion 79 connecting each spring finger 72 to the central region 74. The spring plate 70 is preferably composed of a molded carbon composite or plastic material with sufficient elastic properties to allow the structure to deform and return to its original shape. As shown in the Figures, the interior facing surface 73 of the spring plate 70 preferably includes a polygonal lattice structure 73*a* to provide rigidity and reduce the overall thickness and mass of the spring plate 70. The spring plate 70 is disposed above the first plate 60 so that an interior facing surface 73 faces the hollow interior 24 of the golf club head 10, an exterior surface 75 faces the interior facing surface 61 of the first plate 60, and the spring fingers 72 are at least partially disposed within the groove area 59.

Figure 6:
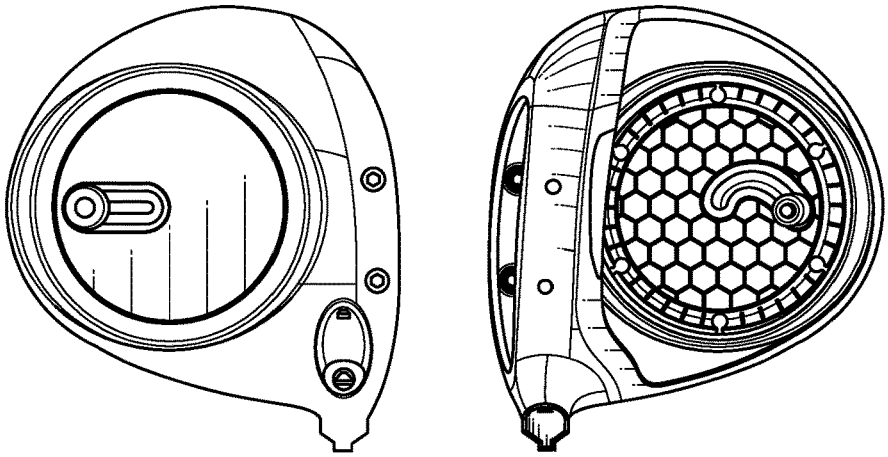
FIG. 6 is a grid illustrating performance properties of the embodiment shown in FIG. 1 with the weight assembly in different configurations.
Figure 6:
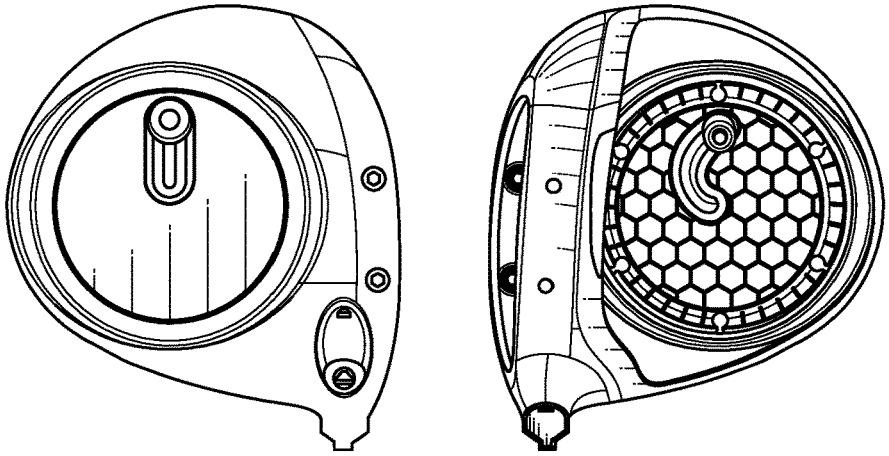
Figure 6:
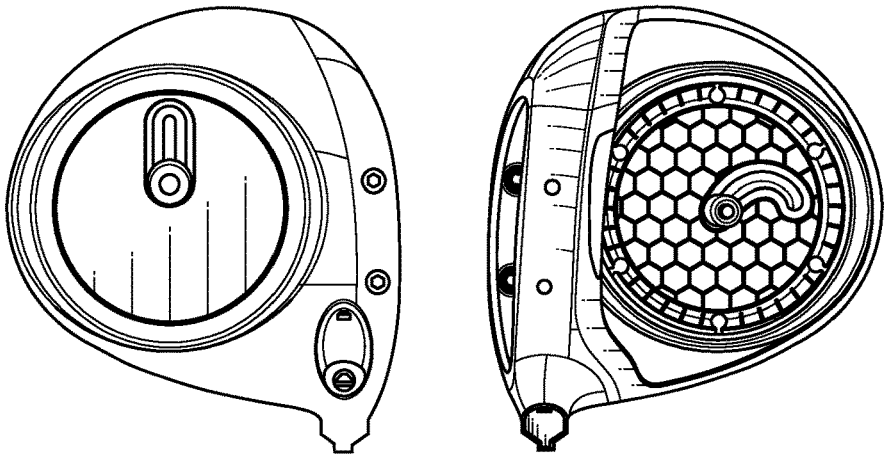
Figure 6:
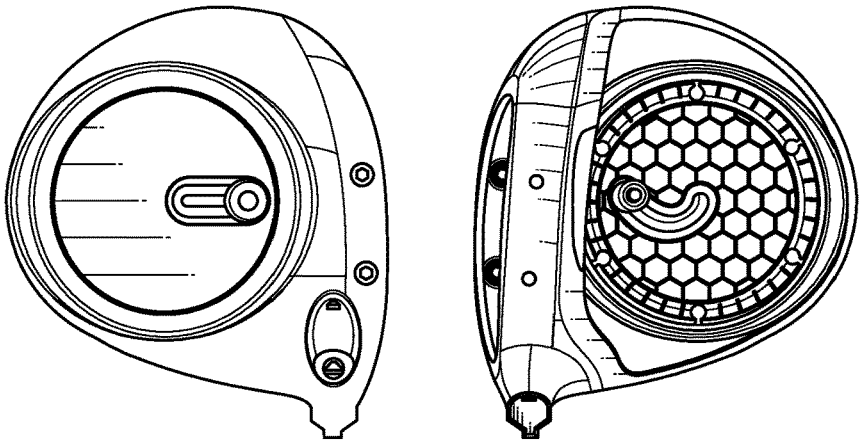
Figure 6:
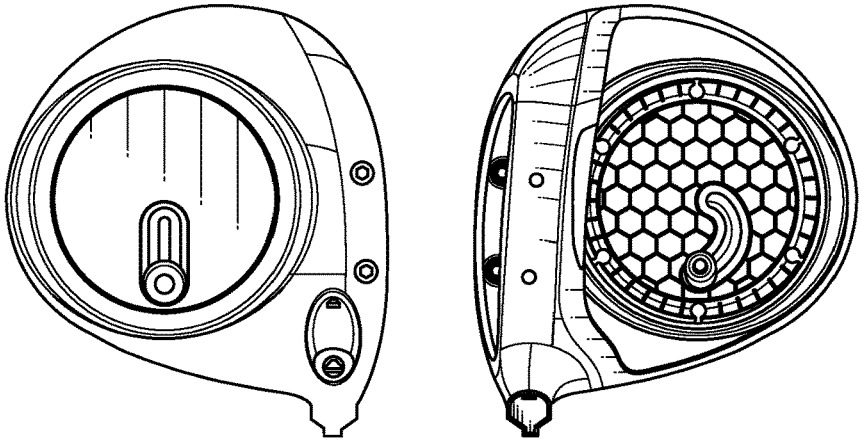
Figure 6:
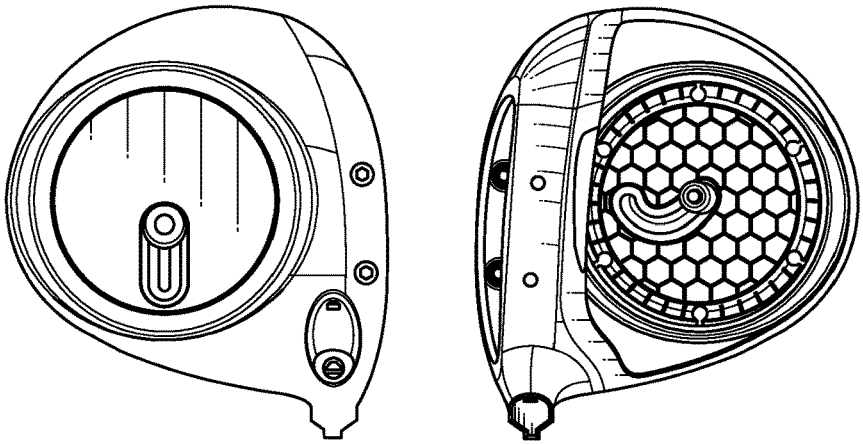

A slidable weight 80 comprising a weight portion 82, a nut 84, and a bolt or screw 86 connects the plates 60, 70 to one another. When the slidable weight 80 is loosened so that the weight assembly of the present invention is in an adjustment state, the plates 60, 70 are disposed within the circular opening 42 so that at least a portion of each edge region 62, 72 is disposed in the groove area 59. In this adjustment configuration, the plates 60, 70 are separated from one another by a small gap and the spring fingers do not touch the first lip 52. The slots 68, 78 align, at least partially, so there is a through-opening from the exterior of the golf club head 10 into the hollow interior 24. While the slidable weight 80 is in a loosened state, the nut 84 rests against the interior facing surface 73 of the spring plate, the weight portion 82 rests in the channel portion 66 of the first plate 60, and the bolt extends through the weight portion 82, through the slots 68, 78, and into the nut 84. In this configuration, the plates 60, 70 can move with respect to one another and the body 20. In particular, the plates 60, 70 can rotate, with the slots 68, 78 moving in accordance with the rotation of the plates 60, 70. This allows the slots 68, 78 to be moved to multiple different positions on the lower portion of the body 20, and the slidable weight 80 can be moved to various positions within the slots 68, 78, to alter the mass properties and performance characteristics of the golf club head 10 (such as moment of inertia, spin, draw, and fade), as illustrated in FIG. 6.

Once a user has selected the desired location of the slidable weight 80, he or she can reversibly fix the plates 60, 70 to the body 20 by tightening the slidable weight 80 with a tool (not shown). By tightening the screw 86, the nut 84 and the weight portion 82 are pulled towards one another, sandwiching the plates 60, 70 between the nut 84 and the weight portion 82 and pushing the plates 60, 70 together. This causes the knuckle portion 79 to press the edge region 62 of the first plate 60 into the contact side 56*a* of the flange 56, which causes the spring fingers 72 to move inward toward the hollow interior 24 and press against the first lip 52, thereby immobilizing the plates 60, 70 via friction. It is important that both plates 60, 70 be stiff enough to allow the load applied by the slidable weight 80 to transfer to the first lip 52; if the plates 60, 70 are not stiff enough, they will deform and will not be capable of being immobilized within the retention structure 50.

In addition to the mass property adjustment benefits of the present invention described above, clamping of the plates 60, 70 at their periphery (as opposed to their central regions 64, 74) allows the assembly to resist a large moment during use of the golf club head 10.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A golf club head comprising:

a body comprising a sole with and an opening that is at least partially encircled by a retention structure;

a first plate comprising a first central region, an edge region encircling the first central region, and a first slot disposed in the first central region;

a second plate comprising a second central region, at least one spring finger extending from the second central region, and a second slot disposed in the second central region; and a weight assembly comprising a weight portion, a screw, and a nut, wherein the retention structure comprises a first lip, a second lip, and a groove area between the first and second lips, wherein a portion of each of the edge region and the at least one spring finger is disposed within the groove area so that the first and second central regions of the first and second plates are at least partially suspended within the opening in the sole, wherein a portion of the first slot overlaps a portion of the second slot, wherein the screw extends through the weight portion, the first slot, and the second slot to engage the nut, and wherein moving the slidable weight to different locations within the slots alters the mass properties of the golf club head.

2. The golf club head of claim 1, wherein tightening the screw presses the first and second plates together between the weight portion and the nut and causes the edge region to press against the first lip and the at least one spring finger to press against the second lip to reversibly fix the first and second plates to the body.

3. The golf club head of claim 1, wherein the at least one spring finger is connected to the central region by a curved knuckle portion.

4. The golf club head of claim 1, wherein the at least one spring finger comprises a plurality of spring fingers, and wherein each of the plurality of spring fingers is separated from adjacent spring fingers by one of a plurality of dividing slots.

5. The golf club head of claim 1, wherein the sole is composed of a first material having a first density, and wherein at least one of the first plate and second plate is composed of a second material having a second density that is lower than the first density.

6. The golf club head of claim 5, wherein the first material is a metal alloy and wherein the second material is selected from the group consisting of plastic and carbon composite.

7. The golf club head of claim 6, wherein each of the first and second plates is composed of a carbon composite material.

8. The golf club head of claim 1, wherein the second plate comprises a lattice support structure.

9. The golf club head of claim 1, wherein the second lip comprises a flange and a shelf, wherein the first lip at least partially overlaps the shelf, and wherein the first edge region abuts the flange.

10. The golf club head of claim 9, wherein the shelf comprises a concavity.

11. The golf club head of claim 1, wherein the first slot is linear and wherein the second slot is curved.

12. The golf club head of claim 1, wherein each of the first and second central regions has a concave curvature.

13. The golf club head of claim 12, wherein the concave curvature of each of the first and second central regions is approximately equivalent to a curvature of the sole.

14. A golf club head comprising:

a body comprising a face portion with a face opening, a sole, a hosel, a heel side proximate the hosel, a toe side opposite the heel side, a rear edge, an upper opening, a sole opening, a retention structure encircling the sole opening, and a hollow interior;

a crown affixed to the body to enclose the upper opening;

a face insert affixed to the body to close the face opening;

a first plate comprising a first central region, an edge region encircling the first central region, a linear track disposed in the first central region and extending from a center point of the first central region towards the edge region, and a first slot disposed in the linear track;

a second plate comprising a second central region, a plurality of spring fingers extending from the second central region, and a second slot disposed in the second central region; and a slidable weight comprising a weight portion, a screw, and a nut, wherein a portion of each of the edge region and each spring finger of the plurality of spring fingers is disposed within the groove area so that the first and second central regions of the first and second plates are at least partially suspended within the sole opening, wherein a portion of the first slot overlaps a portion of the second slot, wherein the screw extends through the weight portion, the first slot, and the second slot to engage the nut, and wherein moving the slidable weight to different locations within the slots alters the mass properties of the golf club head.

15. The golf club head of claim 14, wherein the second slot is curved.

16. The golf club head of claim 14, wherein the second lip comprises a flange and a shelf, wherein the first lip at least partially overlaps the shelf, and wherein the edge region abuts the flange.

17. The golf club head of claim 16, wherein each spring finger of the plurality of spring fingers is connected to the central region by a curved knuckle portion, and wherein each knuckle portion rests against the edge region of the first plate.

18. The golf club head of claim 16, wherein when the slidable weight is in a loosened state, the spring fingers do not make contact with the first lip, and wherein when the slidable weight is in a tightened state, the spring fingers press against the first lip and the edge region presses against the flange to reversibly fix the first and second plates to the body.

19. The golf club head of claim 14, wherein each of the first and second plates are rotatable with respect to one another and the body when the slidable weight is in a loosened state.

20. The golf club head of claim 14, wherein each of the first and second plates is composed of a molded carbon composite material.

* * * * *